US008662249B2

(12) United States Patent
Nair et al.

(10) Patent No.: US 8,662,249 B2
(45) Date of Patent: Mar. 4, 2014

(54) MULTI-LAYERED SOUND ATTENUATION MECHANISM

(75) Inventors: Prashant Unnikrishnan Nair, Sugar Land, TX (US); Nitin Vaidya, Singapore (SG)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/395,943

(22) PCT Filed: Jun. 25, 2010

(86) PCT No.: PCT/IB2010/052928

§ 371 (c)(1), (2), (4) Date: Jul. 11, 2012

(87) PCT Pub. No.: WO2011/036575

PCT Pub. Date: Mar. 31, 2011

(65) Prior Publication Data

US 2013/0048417 A1 Feb. 28, 2013

Related U.S. Application Data

(60) Provisional application No. 61/245,739, filed on Sep. 25, 2009.

(51) Int. Cl.
*E04B 1/82* (2006.01)

(52) U.S. Cl.
USPC ..... 181/292; 181/284; 181/290

(58) Field of Classification Search
USPC ..... 181/284, 290, 292
See application file for complete search history.

(56) References Cited

U.S. PATENT DOCUMENTS

| | | | | |
|---|---|---|---|---|
| 3,243,374 | A | | 3/1966 | Gillard |
| 3,630,310 | A | | 12/1971 | Federer |
| 3,876,034 | A | | 4/1975 | Antonini |
| 3,881,569 | A | | 5/1975 | Evans, Jr. |
| 3,961,682 | A | | 6/1976 | Dausch et al. |
| 4,040,212 | A | | 8/1977 | Goransson |
| 4,130,972 | A | | 12/1978 | Varlonga |
| 4,292,356 | A | | 9/1981 | Whitemore et al. |
| 4,558,850 | A | | 12/1985 | Melfi |
| 4,560,028 | A | * | 12/1985 | Perret ..... 181/288 |
| 4,769,271 | A | | 9/1988 | Sekimoto |
| 4,851,271 | A | | 7/1989 | Moore, III et al. |
| 5,004,070 | A | | 4/1991 | Wang |
| 5,258,585 | A | | 11/1993 | Juriga |
| 5,377,065 | A | | 12/1994 | Morehouse et al. |
| 5,512,715 | A | | 4/1996 | Takewa et al. |
| 5,545,861 | A | | 8/1996 | Morimoto |
| 5,588,810 | A | | 12/1996 | DiFlora et al. |
| 5,678,364 | A | | 10/1997 | Shima et al. |

(Continued)

*Primary Examiner* — Forrest M Phillips
(74) *Attorney, Agent, or Firm* — Michael Flynn; Timothy Curington; Robin Nava

(57) ABSTRACT

A sound attenuation mechanism made up of multiple substrate layers, including corrugated layers. The use of corrugation provides an inexpensive and manner of forming a plurality of highly effective acoustic attenuation channels throughout the mechanism. The multi-layered mechanism may be provided in a variety of modular forms and sizes which may be combined to form a low-cost, highly effective attenuation housing. For example, such a housing may be utilized to contain otherwise noisy large scale oilfield equipment such as coiled tubing engines. Additionally, where drainage from the housing is sought, a spiraled attenuation channel may be employed such that the effectiveness of the attenuation provided by the housing is not sacrificed.

23 Claims, 6 Drawing Sheets

(56) References Cited

U.S. PATENT DOCUMENTS

| | | | | |
|---|---|---|---|---|
| 5,927,129 | A | 7/1999 | Thoms et al. | |
| 5,971,099 | A | 10/1999 | Yasuda et al. | |
| 6,013,362 | A | 1/2000 | Takahashi et al. | |
| 6,062,033 | A | 5/2000 | Choi | |
| 6,183,837 | B1 | 2/2001 | Kim | |
| 6,609,591 | B2 | 8/2003 | Wisniewski | |
| 6,619,425 | B2 | 9/2003 | Miyakawa et al. | |
| 7,398,855 | B2 | 7/2008 | Seel | |
| 7,604,095 | B2 * | 10/2009 | Mitchell | 181/290 |
| 8,251,175 | B1 * | 8/2012 | Englert et al. | 181/292 |
| 8,312,963 | B2 * | 11/2012 | Ogawa et al. | 181/290 |
| 2006/0219475 | A1 * | 10/2006 | Olsen et al. | 181/214 |
| 2007/0122568 | A1 * | 5/2007 | Blomeling | 428/31 |
| 2007/0154682 | A1 | 7/2007 | Connelly et al. | |
| 2007/0272482 | A1 | 11/2007 | Yamaguchi et al. | |
| 2008/0223655 | A1 * | 9/2008 | Peiffer et al. | 181/292 |
| 2009/0090580 | A1 * | 4/2009 | Hotzeldt et al. | 181/290 |

* cited by examiner

MULTI-LAYERED SOUND ATTENUATION MECHANISM

FIELD

Embodiments described relate to resonator mechanisms for use in sound attenuation. In particular, embodiments of resonator mechanisms configured to dramatically reduce decibel output from over about 100 dB to below about 85 dB are described. Such resonators may be particularly beneficial for use in the oilfield industry. For example, these resonator mechanisms may be used to construct sound attenuation housings for large engines and other oilfield equipment.

BACKGROUND

While a hydrocarbon well is often no more than a foot in diameter, overall operations at an oilfield may be quite massive. For example, even in the case of offshore operations, with footspace limited to a discernable platform, the amount of manpower, expense, and equipment involved may be daunting. This is particularly true when considering everything involved in drilling, completing and managing a productive well. Indeed, as described below, the amount of noise alone from such operations may present considerable challenges.

Noise generated by the surface equipment involved in oilfield operations is often quite significant. For example, well management and interventional equipment such as coiled tubing is often directed through use of high pressure pumps which are in turn driven by large engines. These engines may be large scale diesel engines which, under normal operating conditions, exceed about 115 dB in noise output. Unfortunately, in many jurisdictions, this level of noise exceeds acceptable statutory thresholds, generally set at about 90 dB. For example, populated areas near the North Sea, may prohibit near offshore employment of equipment exceeding such noise output. Furthermore, even in absence of nearby population centers or statutory regulation, such noise output may pose a health hazard to operators at the well site. This is particularly true in the case of ongoing operations where such equipment is likely to be run on a near-continuous basis for days on end. For example, this may be a likely scenario for coiled tubing interventions directed at a well location several thousand feet into the well.

In order to reduce health hazards to operators and keep noise level at acceptable statutory levels, efforts have been made to dampen or reduce the decibel level emanating from such equipment. Generally such damping involves positioning of the equipment within a thick walled housing. As such, layers of walls may serve to reduce the amount of sound or noise which travels beyond the housing. For example, in most cases, layers of stainless steel or other suitable material walls may be used for a housing that effectively dampens an engine noise output of about 115 dB to less than 100 dB as perceived from outside of the housing.

Unfortunately, damping through use of a flat walled housing has its practical limits. That is, the amount of damping achieved through such means is inversely exponential to the thickness of the walls. So, for example, depending on the materials used, each decibel reduction attained may be accompanied by a doubling in wall thickness of the housing. Thus, ultimately, in order to reduce a 115 dB output to less than about 90 dB as described above, an immense, expensive and completely impractical housing would need to be constructed. Even mobilizing such a housing and engine at the well site would not be practical, particularly in the case of offshore operations.

As an alternative to damping through use of flat walled housings, sound proofing may be attempted through use of more sophisticated wall architecture. For example, spherical attenuator designs, often referred to as Helmholtz designs, may be employed where spherical bodies are effectively imbedded throughout the housing walls. This may be achieved by providing an array of semi-spherical scoops or indentations into each wall layer. Subsequently, the walled layers may be precisely aligned relative to one another such that an array of spheres is effectively disposed between the adjacent layers.

Furthermore, an added level of complexity may be provided with each and every sphere being provided with its own inlet channel. Such channels may be provided in conjunction with the forming of the semi-spherical indentations. Of course, in order to provide only a single inlet channel per sphere, only half of the indentations, perhaps those of just one of the layers, would be provided with the channel. That said, more complicated inlet channel formation may certainly be employed, such as where channels are provided at alternatingly opposite sides of the spheres. Regardless of the particular design and complexity, such spherical resonators are vastly more effective as compared to flat walled attenuation described above.

Unfortunately, while very effective at damping noise, for example from 115 dB to well below 90 dB, the expense of constructing a spherical resonator large enough to serve as a housing for oilfield equipment remains impractical. That is, while practical in terms of wall thickness, a spherical resonator large enough to house a coiled tubing engine, for example, may run several hundred thousand dollars or more due to the level of sophistication required in construction. As a result of such impractically large and/or expensive alternatives, operators of such high noise equipment are primarily left with the option of operating below capacity to keep noise levels within safe and statutory limits.

SUMMARY

A sound attenuation mechanism is provided which is made up of separate layers coupled to one another. One of the layers is corrugated with a plurality of alternating elongated concave and convex surface features. The other is coupled thereto in a manner that forms a plurality of acoustic attenuation channels between the layers. This other layer may also be corrugated with alternating elongated concave and convex surface features. Alternatively, this other layer may be substantially planar.

An embodiment of a sound attenuation mechanism comprises a corrugated substrate layer and an adjacent substrate layer over the corrugated substrate layer, the adjacent substrate layer coupled to the corrugated substrate layer to form a plurality of acoustic attenuation channels therebetween. In an embodiment, the adjacent substrate layer is corrugated. In an embodiment, the adjacent substrate layer is substantially planar. In an embodiment, the sound attenuation channels are one of cylindrical, oval, sinusoidal, triangular, rectangular, polygonal, and irregularly elliptical-like. In an embodiment, the adjacent substrate layer comprises a plurality of inlets aligned with a plurality of concave surfaces of the corrugated substrate layer. In an embodiment, the mechanism further comprises fibrous material disbursed through the attenuation channels. The fibrous material may be one of wool character, fiberglass, elastic, and an impermeable media. In an embodiment, the mechanism is configured for attenuation of sound of a predetermined magnitude. The sound may be attenuated from on certain noise frequencies with an effective reduction of about 10 db to about 35 db. In an embodiment, the mechanism further comprises plates for encasing the layers to provide the mechanism in modular wall form.

An embodiment of an assembly comprises noise generating equipment and a sound attenuation housing containing the equipment, the housing having a wall of encased substrate layers, at least one of the layers corrugated to form a plurality of acoustic attenuation channels between layers. In an embodiment, the equipment is an engine configured to generate over 100 dB of noise during operation and the housing is configured to attenuate the noise down to less than about 85 dB. In an embodiment, the assembly further comprises a coiled tubing pump coupled to a reel of coiled tubing for an application in a well at an oilfield, the engine being a diesel engine coupled to the pump for powering the application.

An embodiment of a sound attenuation housing comprises a wall of substrate layers with a corrugation formed plurality of acoustic attenuation channels between layers and a spiraled attenuation drain running from the wall for allowing fluid to leave the housing. In an embodiment, the wall and the drain are each configured to afford the housing attenuation of a noise therein of greater than about 100 dB down to less than about 85 dB.

An embodiment of a method comprises corrugating a first substrate layer, coupling a second substrate layer to the first in a manner forming a plurality of acoustic attenuation channels, and employing the coupled layers for attenuating a noise of noise generating equipment. In an embodiment, the method further comprises corrugating the second substrate layer prior to coupling. In an embodiment, the method further comprises aligning the corrugated substrate layers relative the acoustic attenuation channels and encasing the layers in plates to form a modular wall prior to employing. The method may further comprise forming a housing the wall and positioning the noise generating equipment in the housing prior to employing. In an embodiment, the equipment may include an engine for powering an oilfield application. In an embodiment, the noise from the engine may be over about 100 dB in the housing, and the coupled layers may reduce the noise to below about 85 dB outside of the housing.

DETAILED DESCRIPTION

Embodiments herein are described with reference to housings for oilfield equipment, particularly large scale diesel engines. For example, embodiments herein depict engines for driving coiled tubing equipment located in housings of multilayered sound attenuation walls. However, a variety of alternative sound attenuation applications may take advantage of embodiments of sound attenuation mechanisms as detailed herein. Regardless, embodiments of the mechanisms employ corrugation designs and techniques for coupled wall layers. Thus, significant sound attenuation may be achieved without substantially driving up the manufacturing cost of the housings.

Figure 1:
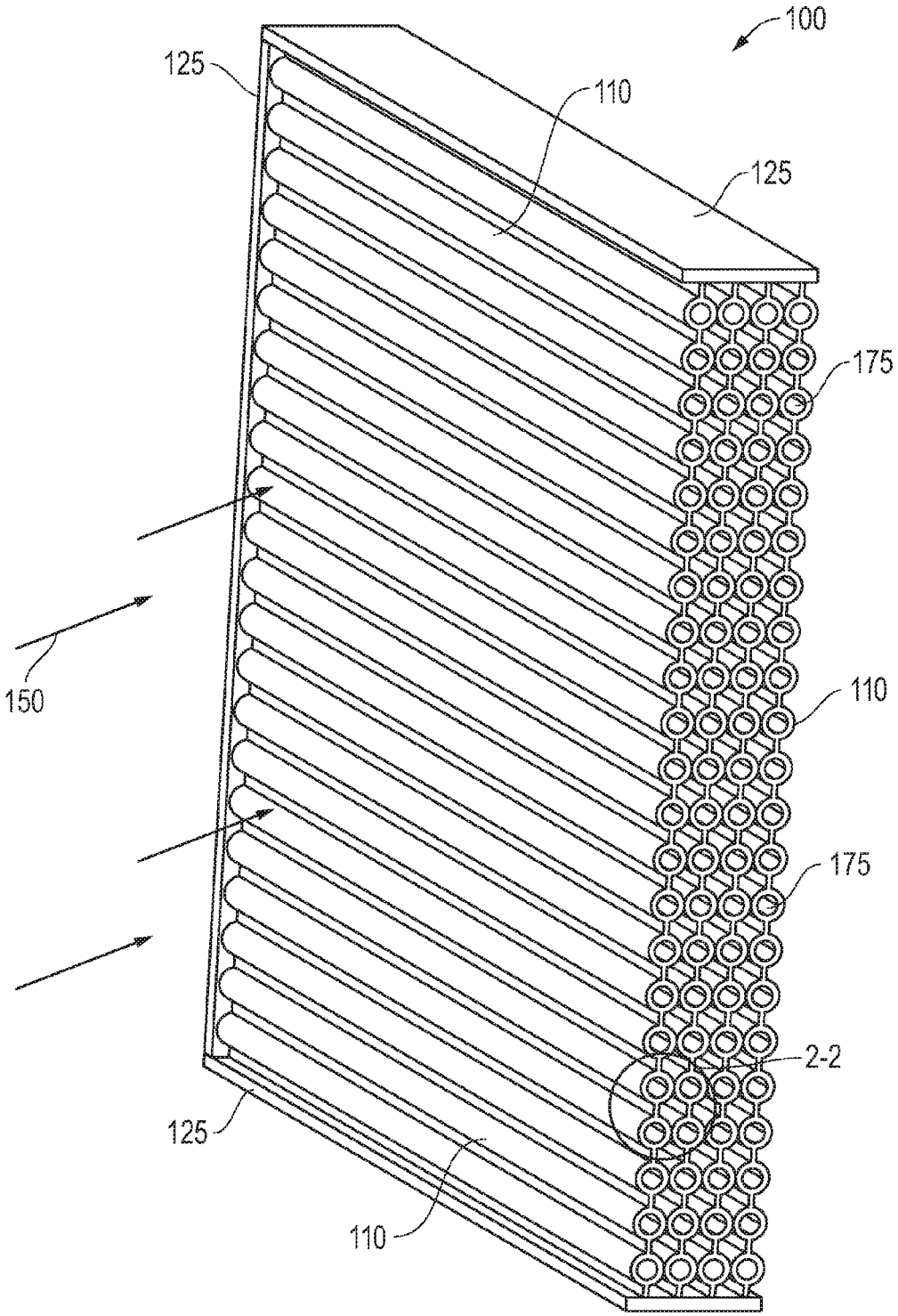
FIG. 1 is a side sectional view of an embodiment of a multilayered sound attenuation mechanism in the form of a wall of a housing.

Referring now to FIG. 1, a side sectional view of an embodiment of a multilayered sound attenuation mechanism 100 is shown. With added reference to FIG. 3, such a mechanism may be incorporated into a wall of a housing 320, 325 for a variety of oilfield equipment as detailed below. In the embodiment of FIG. 1, such a wall mechanism 100 may be made up of what appears to be an assortment of cylinders or tubes, referred to herein as channelizing structures 110 which may be covered by plates 125 to provide added structure. As detailed below, the channelizing structures 110 may be employed to provide significant sound attenuation relative to equipment disposed at the interior of such housings 320, 325.

The channelizing structures 110 noted above define a variety or plurality of acoustic attenuation channels 175. Additionally, as alluded to, the structures 110 appear to be substantially cylindrical. However, in other embodiments, the structures 110 may take on a variety of other shapes as described below. Additionally, with added reference to FIG. 2A, the channels 175 and structures 110 may actually be made up of substrate layers 225, 245, 265, 285. Thus, as described below, conventional low cost corrugation techniques may be employed in patterning surface features of the layers 225, 245, 265, 285 which, once adjacently coupled, effectively form the channelizing structures 110.

The plurality of channelizing structures 110 may behave similarly to conventional spherical attenuation mechanisms in ability to attenuate sound (see arrows 150). For example, with added reference to FIG. 3, sound 150 emanating from an engine at the interior of an engine housing 320 may traverse the housing wall (i.e. attenuation mechanism 100) in a substantially perpendicular fashion. That is, as opposed to being directed through channels 175 running fairly parallel with the sound 150, the sound 150 is directed toward a concave surface 200. Indeed, with added reference to FIG. 2B inlets 290 may be provided at convex surfaces 278 of a layer 285 opposite the concave surface 200. Thus, sound 150 may be more readily directed to the concave surface 200.

Figure 2A:
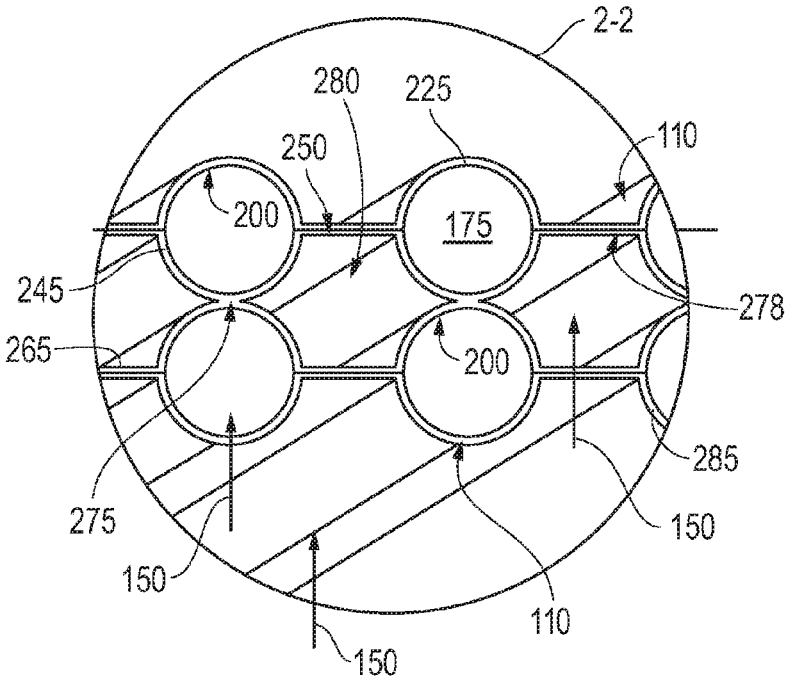
FIG. 2A is an enlarged view of a portion of the wall of FIG. 1 taken from 2-2 thereof.

Continuing now with reference to FIG. 2A, an enlarged view of a portion of the wall of FIG. 1 is shown taken from 2-2 thereof. With particular reference to the concave surfaces 200, a variety of concave morphologies may be employed. In the embodiment shown, these surfaces 200 are substantially semi-cylindrical or semi-tubular. However, these surfaces 200 may be semi-oval, sinusoidal, v-shaped, rectangular or polygonal. Indeed, even the polygonal channel 280 defined by adjacently surrounding channelizing structures 110 provides a polygonal concave surface 278 for sound attenuation. Regardless of the particular morphology, sound wave propagation may be governed by Helmholtz equation:

$$\nabla^2 p + k^2 p = 0$$

where p is the sound pressure, $k=w/c_0$ the wave number, $c_0$ is the speed of sound and $w=2\pi f$ (with f being the frequency).

Figure 2B:
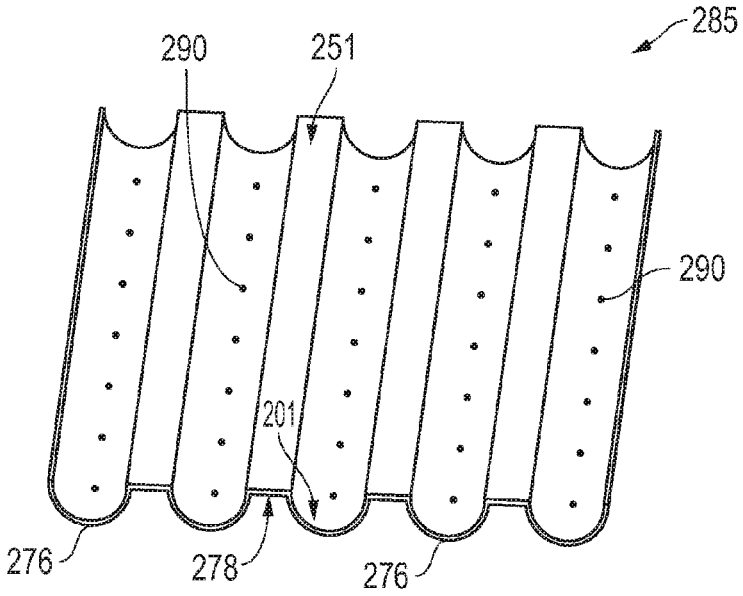
FIG. 2B is a side perspective view of a substrate layer of the wall of FIG. 1 revealing its corrugated character.

Just as for spherical attenuation, the Helmholtz equation may be tailored to compute the lumped impedances provided by a plurality of channelizing structures 110, regardless of the particular morphology or combination of morphologies employed. That is, as alluded to above, the embodiment of FIGS. 1, 2A and 2B provide a combination of roughly semi-cylindrical 200 and polygonal 278 surfaces for sound attenuation. Additionally, the channels 175, 280 may be filled with fibrous material. As such, attenuated sound may be converted to mechanical resonance of the material, Thus, sound through vibrating air may be converted into a non-acoustical heat of vibrating fibrous material. Such embodiments may utilize mineral or rock wool, fiberglass, or other suitable material in this manner. Additionally, elastic and/or impermeable media may be employed.

Continuing with reference to FIG. 2A, the portion of the wall depicted is made up of several substrate layers 225, 245, 265, 285 as indicated. In the embodiment shown, a first layer 225, 265 of repeating semi-cylindrical concave surface features 200 is coupled to an adjacent second layer 245, 285 of repeating polygonal concave surface features 278. Indeed, given the repeatable alternating semi-cylindrical and polygonal morphology, every layer 225, 245, 265, 285 may be formed by the same low cost corrugation processing as described below. That is, following corrugated shaping, substantially identical layers 225, 245 may be oriented to mirror one another and welded together (e.g. at flat weld regions 250 between channelizing structures 110). This may be repeated as shown in the embodiment of FIG. 2A with welding also at the interfaces 275 of channelizing structures 110.

Ultimately, a relatively sophisticated and substantially effective attenuation mechanism of structural layers 225, 245, 265, 285, concave surfaces 200, 278, and channelizing structures 110 may be attained primarily by way of a relatively inexpensive corrugated processing. Indeed, in one embodiment, a mechanism 100 as depicted in FIG. 1 may be constructed of conventional metal sheets or layers 225, 245, 265, 285 as shown in FIG. 2A. These layers 225, 245, 265, 285 may be corrugated and configured as depicted in FIG. 2B, and ultimately assembled into a housing 320 for containing equipment displaying over 100 dB output. Nevertheless, attenuation provided by the housing 320 may effectively reduce dB output outside of the housing to less than about 90 dB.

Referring to FIG. 2B now in more detail, a side perspective view of a given substrate layer 285 of the wall mechanism 100 of FIG. 1 is shown, revealing its corrugated character. That is, the layer 285 may be shaped as depicted by the application of conventional roll forming or corrugation of a metal sheet so as to form a plurality of semi-cylindrical convex surfaces 201 or structural halves 276 of the channelizing structures 110 pointed out in FIGS. 1 and 2A.

The depicted layer 285 of FIG. 2B is shown as oriented with the noted surfaces 201 toward the sound 150 (see also FIG. 2A). Thus, the noted surfaces 201 are referenced as convex with other surfaces 278 appropriately referred to as concave. However, from another vantage point, the same layer 285 may be flipped over and employed in a manner that the noted surfaces 201 would be concave and the other surfaces 278, convex. Indeed, due to the interchangeable nature of different layers, the formation of a mechanism 100 such as depicted in FIG. 1 may be quite efficient. That is, the formation may require little more than, flipping over every other layer prior to adjacently stacking and welding (e.g. at interfaces 275 and weld regions 250 of adjacent structural halves 276 and flat layer portions 251, respectively).

In addition to roll forming or corrugation as described above, certain layers 285 may be provided with sound inlets 290. So, with added reference to FIG. 2A, for example, the substrate layer 285 most directly oriented toward the sound 150 may be provided with inlets 290 for directing the sound 150 into its attenuation channels 175. Such inlets 290 may be formed during or immediately following the corrugating process, for example by use of an array of conventional stamping or rotating piercing implements. Inlets 290 may be provided at the layer 285 most directly oriented toward sound 150 as described. Alternatively, every other layer 285, 245 may be provided with inlets 290. Further, in one embodiment, the inlets 290 may be off-center so as to avoid occlusion during welding for more interior structures 110.

It is worth noting that the above described corrugation differs markedly from say, spherical resonator substrates in which a plurality of scoops or dimples must be individually formed into the layered sheet material. This is particularly true given the challengingly precise alignment of adjacent sheets that is required to form spheres of spherical resonators. Indeed, even the slightest degree of imprecision in scoop or dimple location may render follow-on alignment of adjacent sheets impossible. Employment of channelizing structures 110 in place of spheres, on the other hand, not only renders less expensive corrugation techniques available, but allows for much easier alignment of adjacent layers. Thus, the likelihood of misaligning adjacent layers is also reduced, even further reducing manufacturing cost.

Figure 3:
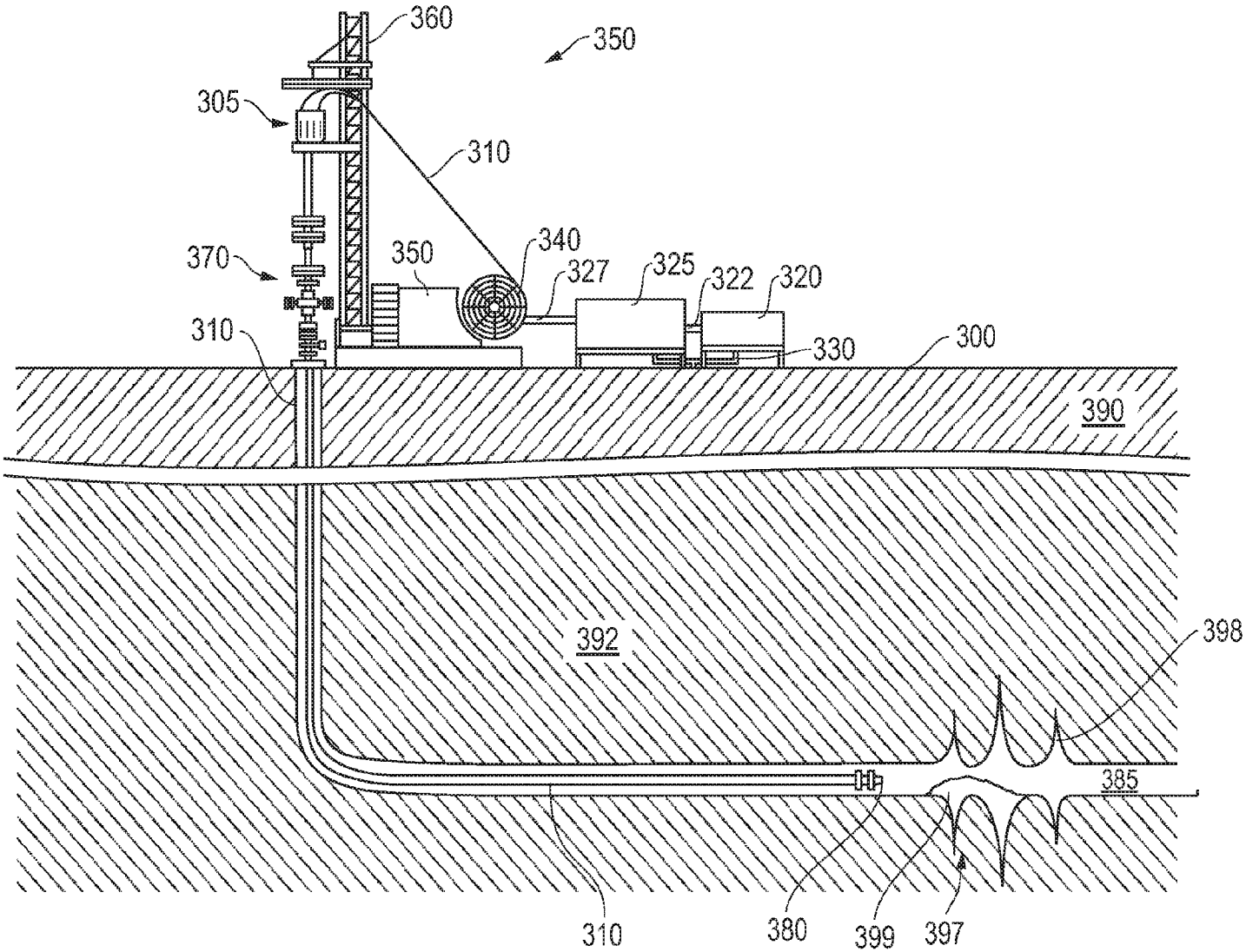
FIG. 3 is an overview of an oilfield supporting equipment contained within housings formed by walls including that of FIG. 1.

Referring now to FIG. 3, an overview of an oilfield 300 is depicted. In this view, surface equipment is provided which may be contained within attenuation housings 320, 325. For example, the housings 320, 325 may be constructed of wall mechanisms 100 as detailed above (see FIG. 1). The use of such modular wall-based mechanisms 100 allows for a fairly flexible design choice when constructing the housings 320, 325. That is, just about any size of walls may be utilized in surrounding a noise source. Further, affixation of walls to one another may be a matter of configuring overlapping joints as in the case of a conventional door frame.

In the particular embodiment shown, the housings 320, 325 may be more specifically a diesel engine attenuation housing 320 adjacent a pump attenuation housing 325. That is, for a coiled tubing operation as depicted, a conventional engine and positive displacement pump may be positioned at the oilfield 300 within the respective housings 320, 325. A similarly attenuated drive shaft 322 may be provided between the housings 320, 325 for driving of the pump by the engine. Further, a high pressure hydraulic line 327 may be linked to a coiled tubing reel 340 for pressurizing of coiled tubing 310 for an application as described below. Additionally, a common sump or drain 330 may run from the housings 320, 325 to allow for fluid drainage therefrom. However, as described below with reference to FIG. 4, due to the fluid nature of the drainage, attenuation of the drain 330 may be separately and uniquely provided apart from multi-layered sound attenuation as detailed hereinabove.

Continuing with reference to FIG. 3, the coiled tubing 310 is run through a conventional gooseneck injector 305, which is itself supported by an adjacent rig 360. The injector 305 may be employed to drive the coiled tubing 310 into the well 385 with a degree of force sufficient to account for the horizontal nature thereof. The coiled tubing 310 is additionally run through a series of valve equipment 370, generally referred to as a 'Christmas Tree', which includes a blow-out-preventor and other pressure control mechanisms.

In the embodiment of FIG. 3, the well 385 traverses various formation layers 390, 395 on its way to a relatively horizontal section which includes a production region 397 with perforations 398. Some of the perforations 398 are occluded by debris 399. Thus, the coiled tubing 310 is equipped with a nozzle 380 for a clean-out application. Advancement of the coiled tubing 310 and direction of the application may be directed by a control unit 350 at surface. However, given the depths involved, the challenging architecture of the well 385 and the nature of a clean out, a significant amount of driving and hydraulic power may be required for carrying out of the application. As a result, in one embodiment, the surface equipment, namely the engine within the engine housing 320, may run at high power, potentially producing over 125 dB of noise. However, as described hereinabove, the attenuating nature of the housing 320 is such that less than about 90 dB of noise output is perceptible outside of the housing 320.

Figure 4:
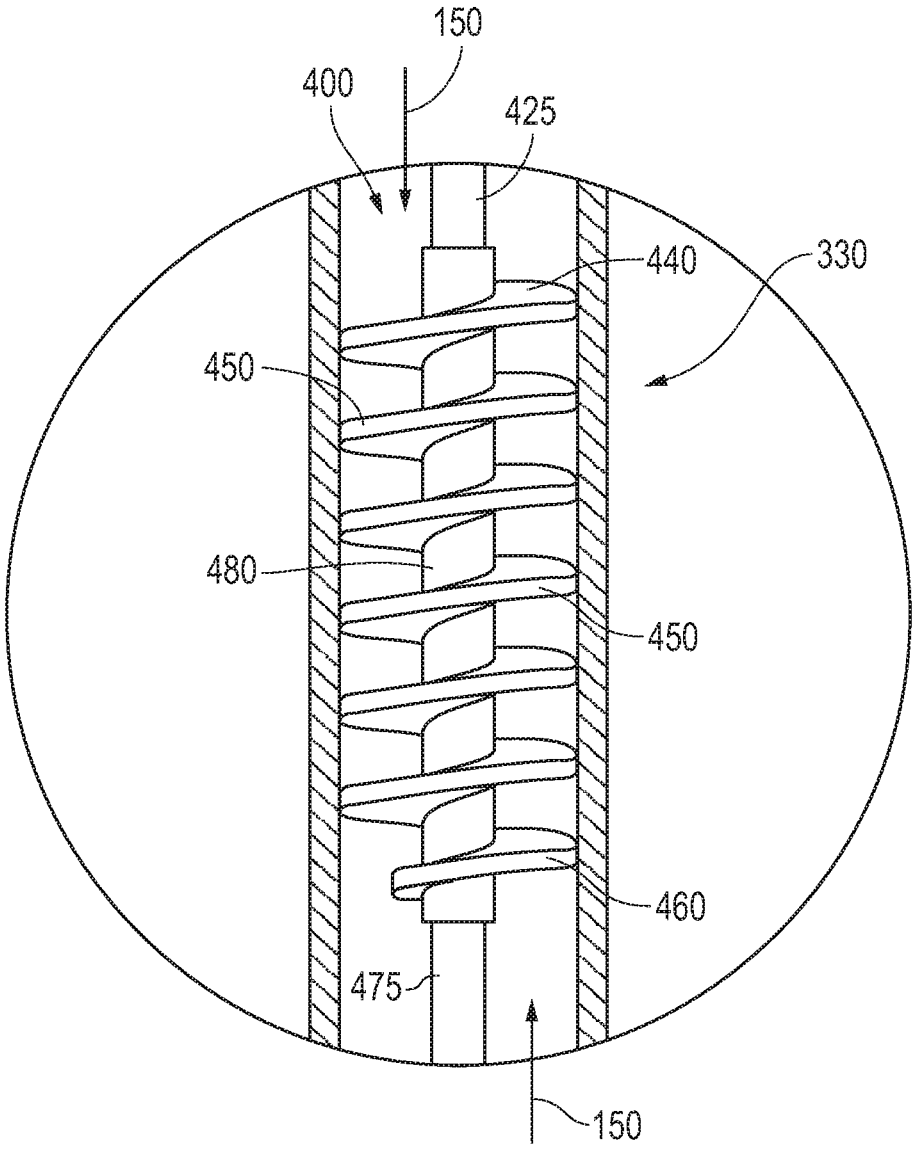
FIG. 4 is a side partially sectional view of an embodiment of a spiral attenuation channel disposed between the housings of FIG. 3.

Referring now to FIG. 4, a side partially sectional view of an embodiment of a spiral attenuation channel 400 is shown disposed between the housings 320, 325 of FIG. 3. More specifically, the above-referenced drain 330 is configured to substantially maintain the attenuation afforded by the housings 320, 325 in spite of remaining open to fluid drainage from the housings 320, 325. This is achieved through use of an attenuation channel 400 coupled to each of the housings 320, 325 as described below.

The above noted attenuation channel 400 includes a drain inlet 425 coupled to a base of a housing 320. The inlet 425 may receive fluid drainage in addition to directing noise into the channel 400 from a source such as a loud engine at the interior of the housing 320. However, upon entry into the channel 400, initial 440, intermediate 450, and terminal 460 spiraling is encountered which serves to substantially attenuate noise. That is, while allowing for any fluid drainage through the continuous channeled spiraling 440, 450, 460, sound is also directed in this manner.

No direct passageway for sound or fluid is provided through the central shaft 480 of the channel 400. Rather, all such drainage is left to drain by way of the spiraled channel thereabout. As a result, in terms of noise passing through the area of the drain 330, substantial attenuation is achieved, particularly in higher frequency ranges. Indeed, in one embodiment, noise entering the inlet 425 at over 100 dB may be reduced to less than about 90 dB by the time it reaches the outlet 475.

Figure 5A:
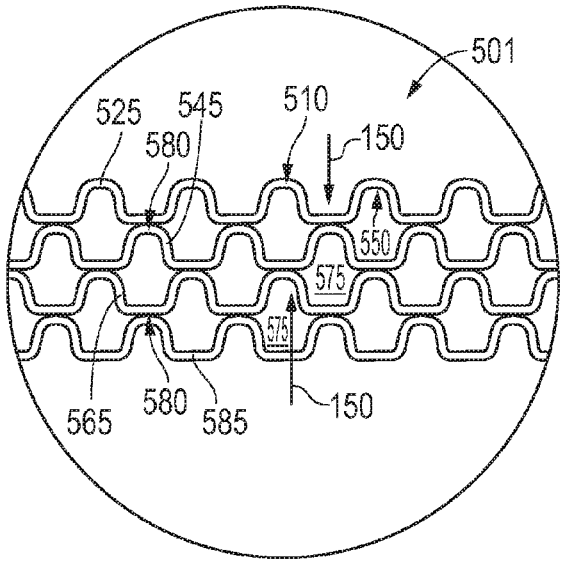
FIG. 5A is a sectional view of a portion of an alternate sinusoidal embodiment of a multilayered sound attenuation mechanism.
Figure 5B:
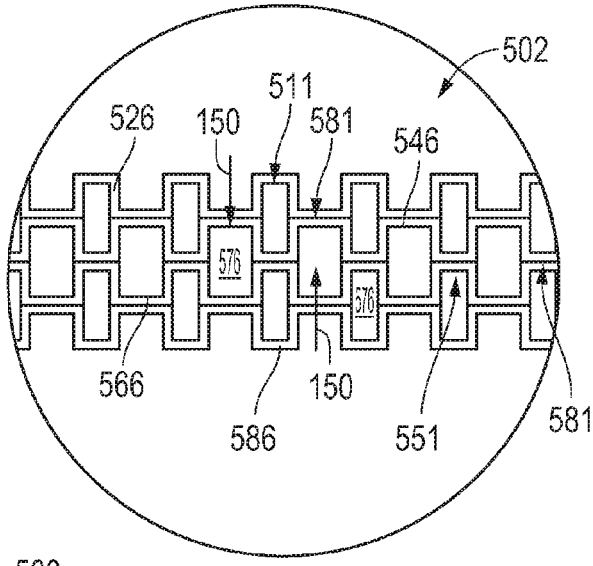
FIG. 5B is a sectional view of a portion of an alternate rectangular embodiment of a multilayered sound attenuation mechanism.
Figure 5C:
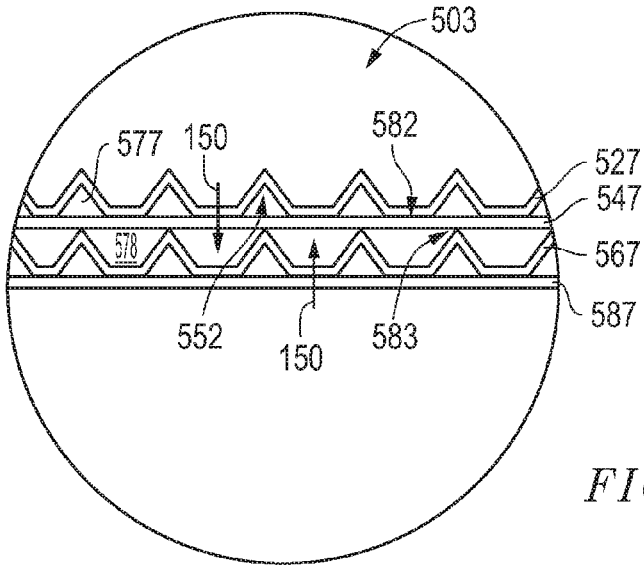
FIG. 5C is a sectional view of a portion of an alternate triangular embodiment of a multilayered sound attenuation mechanism.

Referring now to FIGS. 5A-5C, enlarged views of alternate multilayered configurations are depicted for attenuation mechanisms 501, 502, 503. For example, with particular reference to FIG. 5A, several corrugated substrate layers 525, 545, 565, 585 may again be stacked against one another and welded at interfaces 580. However, unlike the circular channelizing structure 110 of FIG. 1, the corrugation technique employed may provide sinusoidal surfacing 550 and uniquely shaped channelizing structure 510. In the embodiment shown, this structure 510 defines somewhat irregular, elliptical-like attenuation channels 575. Nevertheless, the repeating and alternating, concave and convex nature of the corrugated layers 525, 545, 565, 585, results in a stacked, honeycomb-like matrix of attenuation channels 575. Thus, substantial attenuation may be achieved.

Referring now to FIG. 5B, another alternate embodiment of attenuation mechanism 502 may be configured. In this case, rectangular corrugation may be employed in shaping the substrate layers 526, 546, 566, 586, which are again stacked against one another and welded at interfaces 581. In this case, the rectangular surfacing 551 results in rectangular channelizing structure 511 and attenuation channels 576. Again, however, the repeating and alternating, concave and convex nature of the corrugated layers 526, 546, 566, 586 provides an array of attenuation channels 576 for substantial attenuation.

The embodiments of FIGS. 5A and 5B described above lack the truly cylindrical attenuation detailed above with respect to FIGS. 1, 2A and 2B. However, in addition to still providing substantial attenuation, other advantages may be available through such embodiments. For example, readily available roll forming equipment may often be sinusoidal. However, special order machinery may be avoided and such sinusoidal equipment employed without significant sacrifice to the level of attenuation achievable by the mechanism 501 of FIG. 5A. By the same token, in the embodiment of FIG. 5B, with every interface 581 flat, processing time may be reduced in terms of aligning and welding adjacent substrate layers 526, 546, 566, 586, thus, also potentially reducing cost.

Even further reducing processing time and cost, the embodiment of FIG. 5C, employs triangular attenuation channels 577 with corrugation applied to only half of the substrate layers 527, 567. Nevertheless an array of attenuation channels 577, 578 is still provided for the mechanism 503. In fact, with the other half of the layers 547, 587 being relatively unprocessed planar or flat metal sheets, each interface 582, 583 includes at least one flat surface for welding. Indeed, in an embodiment where no particular alignment of channels 577, 578 is called for, the possibility of misalignment is eliminated altogether. Thus, an even greater reduction in processing time and expense may be realized without significant sacrifice to overall attenuation.

Figure 6:
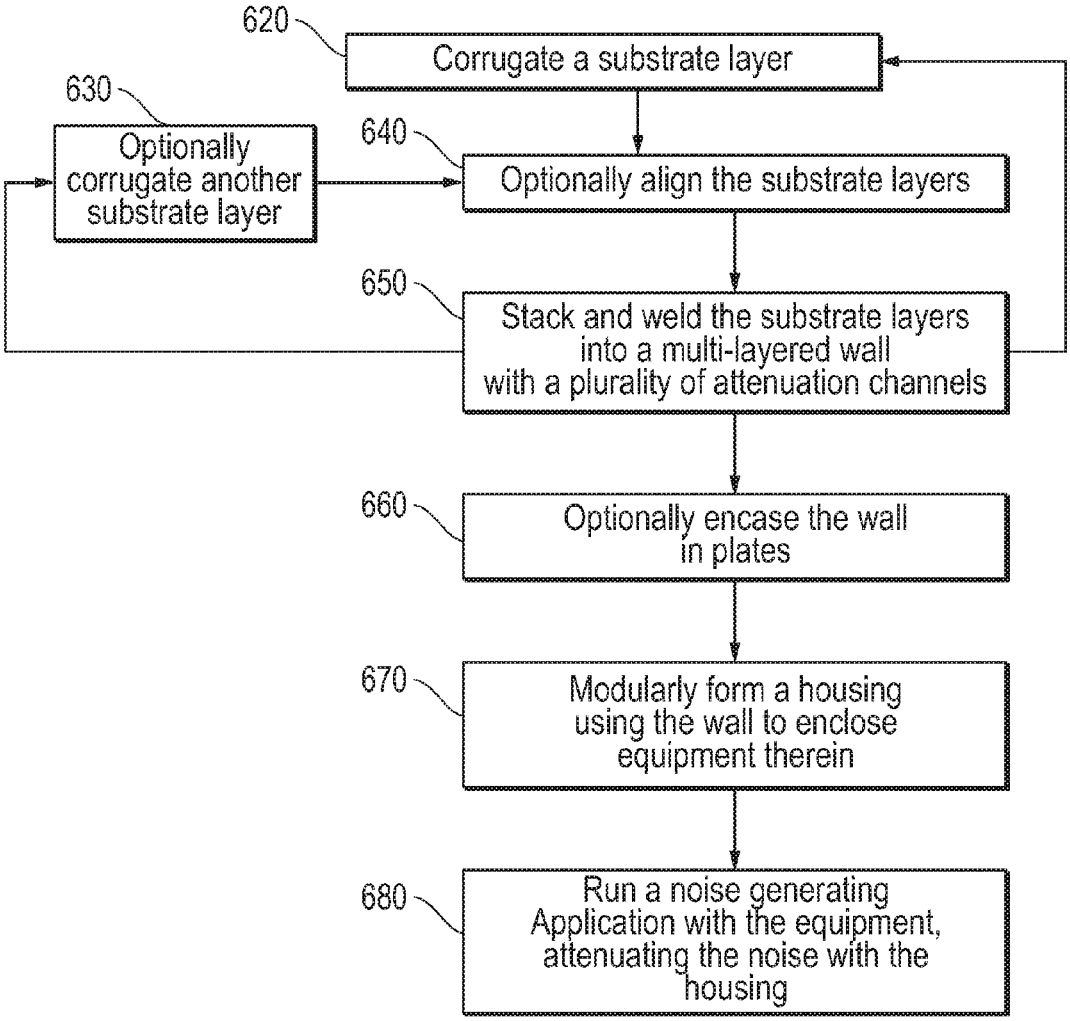
FIG. 6 is a flow-chart summarizing an embodiment of employing a multi-layered sound attenuation mechanism as part of a housing for oilfield equipment.

Referring now to FIG. 6, a flow-chart summarizing an embodiment of employing a multi-layered sound attenuation mechanism as part of a housing is shown. As described above and indicated at 620, at least one substrate layer is corrugated. The corrugated layer may optionally be aligned with another layer, which itself may or may not be corrugated (see 630, 640). Additionally, this may be repeated until the desired number of layers is available. Then, as indicated at 650, the layers may be stacked and coupled to one another forming a wall of attenuation channels. Of note is the fact that such attenuation channels are to be oriented roughly perpendicularly to a noise source as described below (see also FIG. 1).

Once a wall type attenuation mechanism is available it may be encased in plates as indicated at 660 and modularly coupled to other such walls so as to form a housing for enclosing equipment. With such a housing available, a noise generating application may be run by the equipment as indicated at 680, while the noise is attenuated by the housing. Thus, statutory and health concerns, for example, common in the oilfield industry, may be largely minimized.

Embodiments described hereinabove provide substantial damping or sound attenuation that is particularly beneficial for use with large scale industrial equipment such as that employed at an oilfield, offshore or otherwise. The attenuation may be achieved without reliance on flat walled housings which may become quite massive in relatively short order depending on the degree and amount of attenuation sought. Furthermore, while embodiments described herein are configured with Helmholtz attenuation in mind, there is no requirement that purely spherical bodies be employed. As such, substantial attenuation may be achieved at a mere fraction of the processing cost involved in such spherical designs.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A sound attenuation mechanism comprising:

a first corrugated substrate layer; and a second corrugated substrate layer adjacent said first corrugated substrate layer, each of the layers defining concave portions separated by flat regions therebetween, the layers welded together at their respective flat regions to form a plurality of acoustic attenuation channels between the concave portions thereof, wherein at least one of the first or second corrugated substrate layers comprises a plurality of inlets aligned with a plurality of concave surfaces of said first or second corrugated substrate layers, the inlets and the concave surfaces are aligned such that the attenuation channels are substantially perpendicular to the sound being attenuated.

2. The sound attenuation mechanism of claim 1 further comprising:

a third corrugated substrate layer adjacent said second corrugated substrate layer; and a fourth corrugated substrate layer adjacent said third corrugated substrate layer to form another plurality of acoustic attenuation channels therebetween.

3. The sound attenuation mechanism of claim 1 wherein the sound attenuation channels are one of cylindrical, oval, triangular, rectangular, polygonal, and irregularly elliptical-like.

4. The sound attenuation mechanism of claim 1 further comprising fibrous material filling the attenuation channels.

5. The sound attenuation mechanism of claim 4 wherein said fibrous material is one of wool character, fiberglass, elastic, and an impermeable media.

6. The sound attenuation mechanism of claim 1 configured for attenuation of sound of a predetermined magnitude.

7. The sound attenuation mechanism of claim 1 further comprising plates for encasing said layers to provide the mechanism in modular wall form.

8. An assembly comprising:

noise generating equipment; and a sound attenuation housing containing the noise generating equipment, said housing having a wall of encased corrugated substrate layers, wherein at least two of the corrugated substrate layers welded together to form a plurality of acoustic attenuation channels therebetween, the channels filled with a fibrous material and oriented perpendicularly to the noise generating equipment.

9. The assembly of claim 8 wherein said noise generating equipment is an engine configured to generate over 100 dB of noise during operation and said housing is configured to attenuate the noise down to less than about 85 dB.

10. The assembly of claim 9 further comprising a coiled tubing pump coupled to a reel of coiled tubing for an application in a well at an oilfield, the engine being a diesel engine coupled to said pump for powering the application.

11. The assembly of claim 8 wherein said plurality of sound attenuation channels being configured to attenuate noise arriving from the noise generating equipment in a radial direction with respect to a longitudinal axis of the sound attenuation channels.

12. A sound attenuation housing comprising:

a wall of substrate layers with a corrugation forming a plurality of acoustic attenuation channels between said layers; and an attenuation drain defining a channel therein, the channel comprising a continuous chanelled spiraling therein to attenuate noise within the drain, the drain running from said wall for allowing fluid to leave the housing.

13. The sound attenuation housing of claim 12 wherein said wall and said drain are each configured to afford the housing attenuation of a noise therein of greater than about 100 dB down to less than about 85 dB.

14. The sound attenuation housing of claim 12 wherein said plurality of acoustic attenuation channels being configured to attenuate noise along a longitudinal axis of the plurality of acoustic attenuation channels.

15. A method comprising:

corrugating a first substrate layer, the first layer defining concave portions separated by flat regions therebetween:

corrugating a second substrate layer, the second layer defining concave portions separated by flat regions therebetween;

welding the second substrate layer to the first substrate layer at their respective flat regions and at interfaces of the concave portions and forming a plurality of acoustic attenuation channels therebetween; and employing the coupled layers for attenuating a noise of a noise generating equipment by orienting the channels substantially perpendicular to the noise of the noise generating equipment.

16. The method of claim 15 further comprising:

corrugating a third and fourth substrate layer;

coupling the third substrate layer to the second and fourth substrate layers in a manner forming another plurality of acoustic attenuation channels between the second and third substrate layers, and between the third and fourth substrate layers;

aligning the first, second, third and fourth corrugated substrate layers relative to the acoustic attenuation channels; and encasing the first, second, third and fourth corrugated substrate layers in plates to form a modular wall prior to employing.

17. The method of claim 16 further comprising:

forming a housing using the modular wall; and positioning the noise generating equipment in the housing prior to employing.

18. The method of claim 17 wherein the noise generating equipment includes an engine for powering an oilfield application.

19. The method of claim 18 wherein the noise from the engine is over about 100dB in the housing, the plurality of acoustic attenuation channels configured to reduce the noise to below about 85 dB outside of the housing.

20. A method of reducing noise of an oilfield operation, comprising:

using a sound attenuation mechanism, comprising:

a first corrugated substrate layer; and a second corrugated substrate layer adjacent said first corrugated substrate layer, each of the layers defining concave portions separated by flat regions therebetween, the layers welded together at their respective flat regions to form a plurality of acoustic attenuation channels between the concave portions thereof;

wherein using comprises orienting the channels substantially perpendicular to the sound being attenuated.

21. The method of claim 20 further comprising positioning the sound attenuation mechanism near a noise generating equipment.

22. The method of claim 20 wherein at least one of the first or second corrugated substrate layers of the sound attenuation mechanism further comprises a plurality of inlets aligned with a plurality of concave surfaces of said first or second corrugated substrate layers.

23. The method of claim 20 wherein the sound attenuation mechanism further comprises a third corrugated substrate layer adjacent said second corrugated substrate layer; and a fourth corrugated substrate layer adjacent said third corrugated substrate layer to form another plurality of acoustic attenuation channels therebetween.

* * * * *